US012678653B1

(12) United States Patent
Muller

(10) Patent No.: US 12,678,653 B1
(45) Date of Patent: Jul. 14, 2026

(54) BARBELL WEIGHT HOLDER

(71) Applicant: Bjorn Muller, Yuma, AZ (US)

(72) Inventor: Bjorn Muller, Yuma, AZ (US)

( * ) Notice: Subject to any disclaimer, the term of this patent is extended or adjusted under 35 U.S.C. 154(b) by 0 days.

(21) Appl. No.: 19/547,653

(22) Filed: Feb. 23, 2026

(51) Int. Cl.
*A63B 21/078* (2006.01)
*A63B 21/16* (2006.01)

(52) U.S. Cl.
CPC ..... *A63B 21/078* (2013.01); *A63B 21/1627* (2013.01)

(58) Field of Classification Search
CPC ..... A63B 21/078; A63B 21/0783; A63B 21/1618; A63B 21/1627; A63B 21/1636; A63B 21/1645; A63B 21/1654; A63B 21/1663; A63B 21/4035; A63B 2244/09
See application file for complete search history.

(56) References Cited

U.S. PATENT DOCUMENTS

| | | | | |
|---|---|---|---|---|
| 4,854,573 | A * | 8/1989 | Johannson | A63B 23/12 482/141 |
| 5,141,480 | A * | 8/1992 | Lennox | A63B 21/4029 482/142 |
| D631,560 | S * | 1/2011 | Merritt, Sr. | D25/67 |
| 8,926,481 | B2 * | 1/2015 | Moore | A63B 21/0724 482/94 |
| 9,662,537 | B1 | 5/2017 | Graves et al. | |
| 10,265,582 | B2 | 4/2019 | Price | |
| 10,486,014 | B1 | 11/2019 | Trotter, Jr. | |
| D907,725 | S * | 1/2021 | Adams | D21/694 |
| D913,385 | S * | 3/2021 | Trenkle | D21/694 |
| D915,533 | S * | 4/2021 | Adams | D21/694 |
| D967,911 | S * | 10/2022 | Wang | D21/679 |
| 11,701,541 | B1 * | 7/2023 | Jacobson | A63B 21/0724 482/106 |
| D1,040,950 | S * | 9/2024 | Diehl | D21/680 |
| D1,120,154 | S * | 3/2026 | Patterson | D21/694 |
| 2001/0049324 | A1 * | 12/2001 | Wallace | A63B 21/0783 482/106 |

(Continued)

FOREIGN PATENT DOCUMENTS

| | | | | |
|---|---|---|---|---|
| DE | 102021001626 | A1 * | 9/2022 | A63B 23/1236 |
| GB | 2483641 | A * | 3/2012 | A63B 23/12 |

(Continued)

*Primary Examiner* — Gary D Urbiel Goldner
(74) *Attorney, Agent, or Firm* — Nolan Heimann LLP; Adam Diament

(57) ABSTRACT

A support device for exercise implements, comprising a plate member formed as a single unitary piece with a generally planar configuration. The plate member defines an upper portion, a lower portion, and a lateral portion collectively forming a perimeter edge. A first opening extends through the plate member, bounded by the upper and lateral portions, and configured to receive an elongated exercise implement of the exercise implements. A second opening is formed below the first opening. At least one fastener aperture receives a mechanical fastener for mounting to a supporting structure. The upper portion includes a downwardly extending portion with a contoured edge configured to cradle the elongated exercise implement, sloping-toward a catch portion that prevents lateral displacement of the elongated exercise implement. The upper portion terminates in a tapered protrusion adjacent to the catch portion.

11 Claims, 9 Drawing Sheets

(56) References Cited

U.S. PATENT DOCUMENTS

| | | | | |
|---|---|---|---|---|
| 2012/0258846 | A1* | 10/2012 | Wilson | A63B 21/4035 482/141 |
| 2012/0289384 | A1* | 11/2012 | Staten | A63B 21/0783 482/104 |
| 2016/0144230 | A1* | 5/2016 | An | A63B 23/1218 482/40 |
| 2016/0271444 | A1 | 9/2016 | Payne | |
| 2017/0259101 | A1* | 9/2017 | Im | A63B 1/00 |
| 2018/0353795 | A1* | 12/2018 | Ostmeyer | A63B 1/00 |
| 2020/0147434 | A1 | 5/2020 | Garcia, Jr. | |
| 2020/0197737 | A1* | 6/2020 | Kistner | A63B 1/005 |
| 2021/0379435 | A1* | 12/2021 | Harker | A63B 1/00 |
| 2023/0293934 | A1* | 9/2023 | Marazzini | A63B 21/0783 482/104 |
| 2024/0307731 | A1* | 9/2024 | Meredith | A63B 17/02 |
| 2025/0319342 | A1* | 10/2025 | Patterson | A63B 1/00 |

FOREIGN PATENT DOCUMENTS

| | | | | |
|---|---|---|---|---|
| IT | 202100008306 | A1 * | 10/2022 | A63B 21/078 |
| WO | WO-2024208503 | A1 * | 10/2024 | A63B 21/0605 |

* cited by examiner

BARBELL WEIGHT HOLDER

CROSS-REFERENCE TO RELATED APPLICATIONS

None.

FIELD OF INVENTION

The present disclosure relates to exercise equipment support devices, and more particularly to a multi-functional support device for selectively supporting, suspending, or interfacing with elongated exercise implements such as barbells, weight bars, and related accessories.

BACKGROUND

Home fitness equipment has grown in popularity as individuals seek convenient ways to maintain physical conditioning without requiring access to commercial gym facilities. Among the various types of exercise equipment, barbell-based weight training systems remain a cornerstone of strength training programs. Barbells and associated weight plates allow users to perform a wide range of exercises targeting different muscle groups, including bench presses, squats, overhead presses, and rows.

Traditional barbell storage and support systems typically include dedicated squat racks, power cages, or wall-mounted brackets designed to hold barbells at various heights during exercise or storage. These conventional systems often occupy substantial floor space and may require permanent installation, making them less suitable for residential environments where space is limited. Many existing barbell support solutions are designed for single-purpose applications, such as supporting a barbell during bench press exercises or storing the barbell when not in use.

Doorframes and wall structures present potential mounting locations for exercise equipment in residential settings, as these structural elements can provide adequate support for moderate loads when properly anchored. However, existing wall-mounted or doorframe-mounted exercise supports may lack versatility in their configurations or may not accommodate the range of barbell types and sizes commonly used in home fitness applications. Standard barbells typically have shaft diameters of approximately one inch, while Olympic barbells feature two-inch diameter sleeves, creating challenges for support devices intended to accommodate both types.

Floor-based barbell supports offer an alternative to wall-mounted systems, allowing users to position barbells at various heights without permanent installation. Such floor stands can facilitate exercises like rows or deadlifts while keeping weight plates elevated above the floor surface for easier loading and unloading. The ability to transition between wall-mounted and floor-based configurations can enhance the utility of a support device in space-constrained environments.

Exercise equipment that can serve multiple functions or accommodate various accessories may provide advantages in home gym applications where storage space and equipment budgets are limited. Support devices capable of interfacing with suspension trainers, dip rings, cable attachments, or other accessories can expand the range of exercises available to users beyond traditional barbell movements.

SUMMARY

The present disclosure relates to a support device designed to hold barbells and other exercise equipment. The device addresses the challenge of performing weight training exercises at home without requiring bulky, expensive gym equipment. The support device may be mounted to a door frame or wall, or positioned on a floor surface, providing a versatile solution for home fitness enthusiasts.

The support device is formed as a single plate member with openings and contoured edges that allow it to support a barbell in multiple ways. When mounted to a door frame, the device cradles a barbell on a curved edge, with a raised catch portion that prevents the barbell from rolling off. The device includes holes for attaching it to a wall or door frame using standard hardware such as lag bolts.

In one aspect, the support device includes a plate member with an upper portion, a lower portion, and a connecting lateral portion. The plate member has two openings—a larger opening for accessing and positioning a barbell, and a smaller opening through which a barbell shaft may pass when the device is used as a floor stand. The upper portion features a sloped edge that guides a barbell toward a catch portion, preventing the barbell from sliding off. The upper portion terminates in a tapered protrusion adjacent to the catch portion.

In another aspect, the support device further includes a grip assembly attached to the lower portion of the plate member. The grip assembly comprises two buffer portions that attach to opposite sides of the lower portion, providing a cushioned cylindrical grip surface. The grip assembly may include features that allow it to sit flush with the plate member, preventing instability when the device is used as a floor stand. The grip assembly provides a handle for exercises involving direct hand contact with the device.

The support device may accommodate both standard and Olympic-sized barbells by varying the size of the openings. Additional features may include a rotatable sleeve around the cylindrical grip surface for exercises involving rotation, and a retention element to keep the sleeve in place. The device may also interface with accessories such as dip rings, suspension trainers, and cable attachments, expanding the range of exercises that can be performed.

The foregoing general description of the illustrative embodiments and the following detailed description thereof are merely exemplary aspects of the teachings of this disclosure and are not restrictive.

BRIEF DESCRIPTION OF FIGURES

Non-limiting and non-exhaustive examples are described with reference to the following figures.

DETAILED DESCRIPTION

Figure 1:
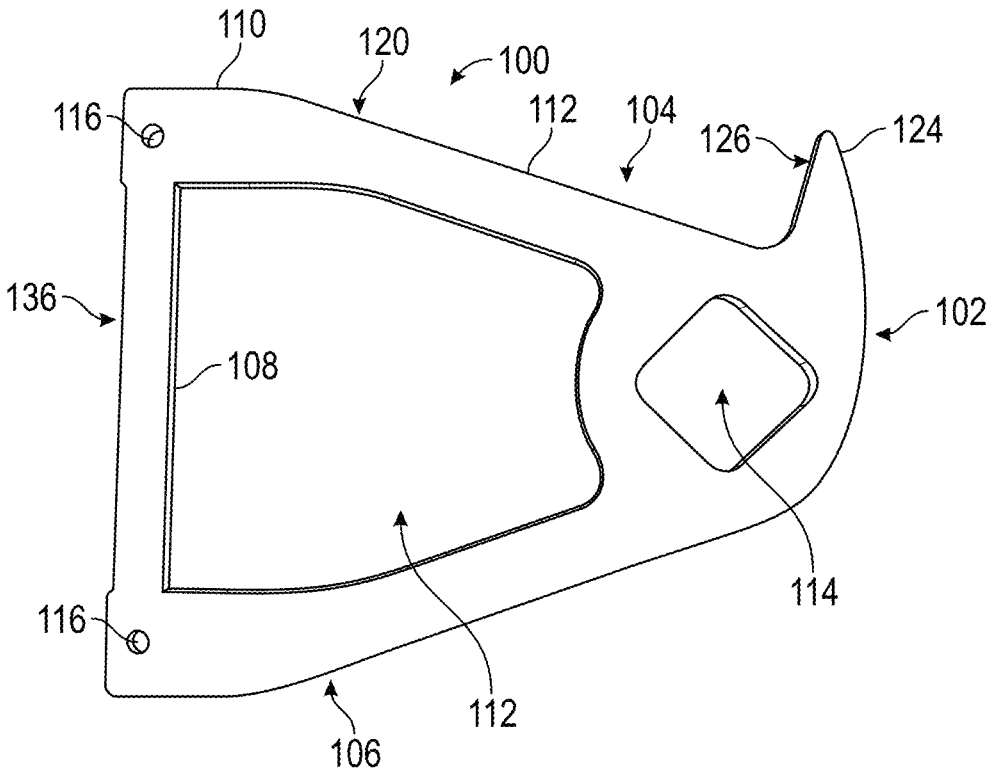
FIG. 1 illustrates an orthogonal view of the support device without the grip assembly attached, showing the plate member, the first opening, the second opening, the fastener apertures, and the downwardly extending portion with the contoured edge, the catch portion, and the tapered protrusion, according to aspects of the present disclosure.

The following description sets forth exemplary aspects of the present disclosure. It should be recognized, however, that such description is not intended as a limitation on the scope of the present disclosure. Rather, the description also encompasses combinations and modifications to those exemplary aspects described herein.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein. All patents, patent applications and non-patent literature cited through this Specification are hereby incorporated by reference in their entireties. References cited in an Information Disclosure Statement should not be construed as an admission that the cited reference comes from an area that is analogous or directly applicable to the invention, but rather that the reference is being cited out of an abundance of caution.

Support Device Structure Overview

The present disclosure relates to a support device configured for use with exercise implements such as barbells and other elongated objects. The support device provides a multi-functional platform for supporting, suspending, or interfacing with elongated exercise implements in various configurations. The support device may be mounted to a supporting structure such as a door frame or wall, or may be positioned on a floor surface to function as a floor stand.

The support device comprises a plate member having a generally planar configuration and formed as a single unitary piece. The plate member defines multiple openings and contoured edges that collectively enable a plurality of support and attachment configurations. The geometry of the openings and edge profiles permits the support device to support objects in multiple positions, orientations, or heights relative to a mounting surface. The support device may interface with additional components such as bars, handles, sleeves, cables, straps, or fasteners depending on the desired exercise configuration.

The support device may be formed from metal, polymer, composite, or combinations thereof. The support device may be used alone or in combination with removable or rotatable accessory components coupled to the openings or edges of the plate member. Variations in the size, shape, number, or arrangement of the openings and edge profiles may be employed to accommodate different types of exercise implements, including standard weights and Olympic weights. The support device may also accommodate cable attachments or D-ring accessories for cable-based exercises.

Referring to FIG. 1, a support device 100 for exercise implements comprises a plate member 102 having a generally planar configuration and formed as a single unitary piece. The plate member 102 defines an upper portion 104, a lower portion 106, and a lateral portion 108 connecting the upper portion 104 to the lower portion 106. The upper portion 104, lower portion 106, and lateral portion 108 collectively define a perimeter edge 110. The lateral portion 108 is positioned between the fastener apertures 116 and includes a recess 136 configured to receive corresponding portions of a grip assembly. The plate member 102 may be formed from metal, such as steel or stainless steel, and in some aspects the plate member 102 exhibits a brushed metallic surface finish with a uniform thickness throughout the profile of the plate member 102. In some aspects, the surface finish may include a polished finish or a mirror finish. The plate member 102 may alternatively be formed from polymer material, composite material, or combinations of metal, polymer, and composite materials.

A first opening is formed through the plate member and is bounded by the upper portion and the lateral portion. The first opening extends fully through a thickness of the plate member and is configured to receive an elongated exercise implement such as a barbell. The first opening provides an internal area for reaching into and positioning a bar within the support device.

With continued reference to FIG. 1, a second opening is formed through the plate member below the first opening. The second opening extends fully through the thickness of the plate member. The second opening may be configured to receive a barbell shaft and may also accommodate cable attachments or D-ring accessories for cable-based exercises. When the support device is positioned on a floor surface, the second opening receives the barbell therethrough to support the barbell above the floor surface.

At least one fastener aperture is formed in the upper portion of the plate member and is configured to receive a mechanical fastener for mounting the support device to a supporting structure such as a door frame or wall. As shown in FIG. 1, the fastener apertures 116 may be positioned near corners of the upper portion.

The upper portion 104 includes a downwardly extending portion 120 that slopes downward from the lateral portion 108 toward a tapered protrusion 124. The downwardly extending portion 120 defines a contoured edge 122 configured to cradle an elongated exercise implement. The contoured edge 122 slopes toward a catch portion 126 that is positioned adjacent to the tapered protrusion 124 and is configured to prevent an elongated exercise implement from displacing laterally when resting on the contoured edge 122. When the support device 100 is mounted to a door frame or wall, an elongated exercise implement such as a barbell may rest on the contoured edge 122 and roll down the slope until it contacts the catch portion 126, which retains the barbell in a stable position. The upper portion 104 terminates in the tapered protrusion 124, which extends upwardly adjacent to the catch portion 126.

The lower portion 106 slopes upward from its lowest point toward the tapered protrusion 124 area. The lower portion 106 and the upper portion 104 angle toward each other but do not meet, with both transitioning into the tapered protrusion 124 region.

Figure 2:
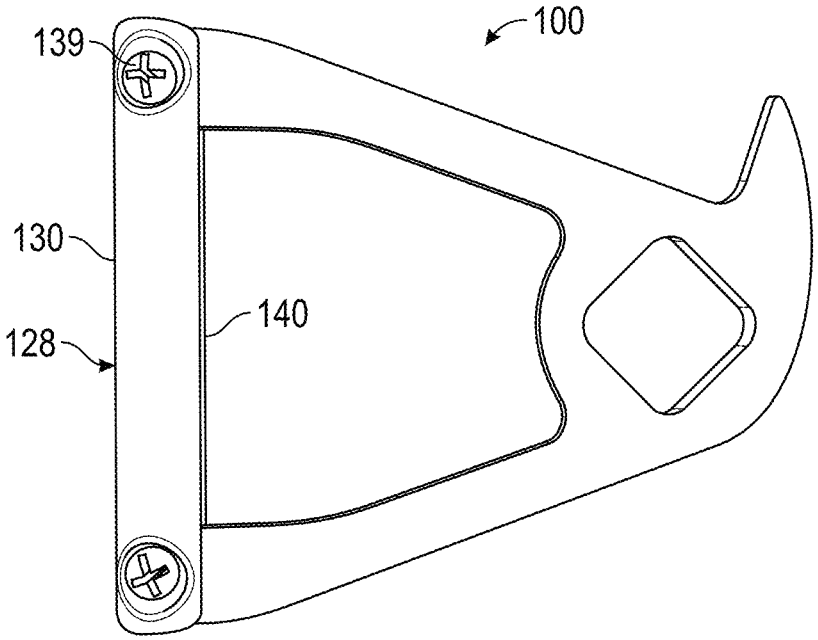
FIG. 2 illustrates a perspective view of the support device with the grip assembly attached to the lower portion of the plate member, including the first buffer portion, the grip assembly fasteners, and the cylindrical grip surface, according to aspects of the present disclosure.

Referring to FIG. 2, the support device 100 may further comprise a grip assembly 128 removably coupled to the lower portion 106 of the plate member 102. The grip assembly 128 comprises a first buffer portion 130 and a second buffer portion 132 configured to attach to opposing sides of the lower portion 106. Each buffer portion includes fastener apertures 134 configured to receive mechanical fasteners for securing the buffer portions together around the lower portion 106. The first buffer portion 130 and the second buffer portion 132 may be formed from a polymer material and may function to dampen impacts during use of the support device 100.

Support Device with Grip Assembly

With continued reference to FIG. 2, the grip assembly 128 defines a cylindrical grip surface 140 having a diameter of between approximately 0.8 inches and approximately 1 inch. The cylindrical grip surface 140 provides a gripping surface for users during exercises involving direct hand contact with the support device. The grip assembly 128 may interface with rotatable sleeves as additional accessory components coupled to the lower portion of the plate member.

The support device may further comprise a rotatable sleeve 142 disposed around the cylindrical grip surface 140. The rotatable sleeve 142 may be used with the support device as a removable accessory component that is rotatable when coupled to the grip assembly 128. The rotatable sleeve 142 allows the support device to accommodate exercises that involve rotation in the grip area, such that the rotatable sleeve 142 may spin freely around the cylindrical grip surface 140.

Doorframe Mounting Configuration

Figure 3:
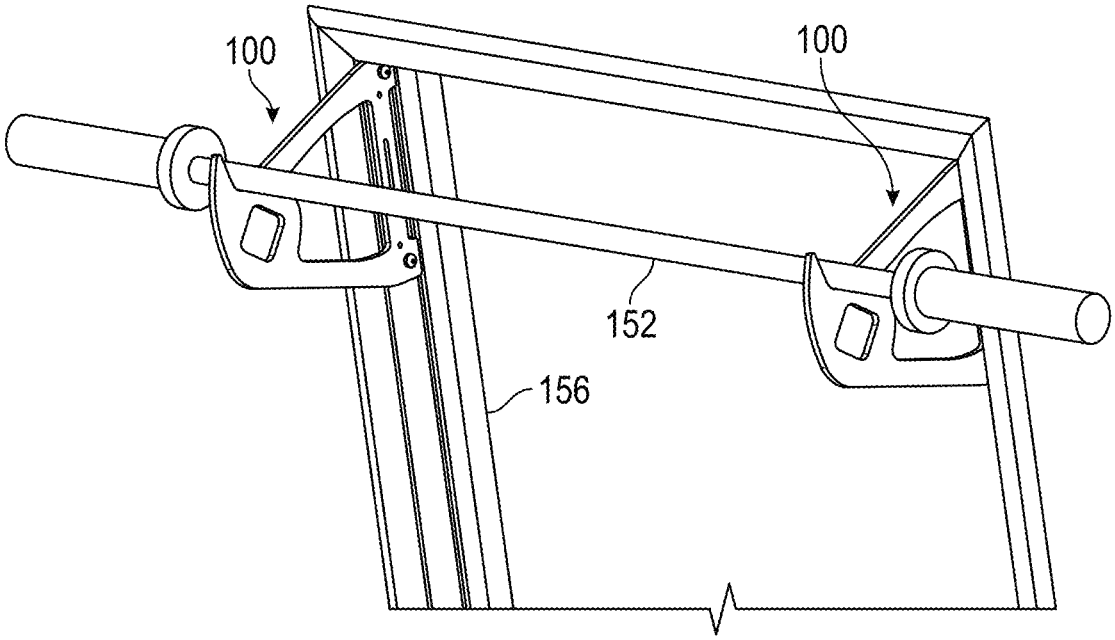
FIG. 3 illustrates a perspective view of a pair of support devices mounted to a door frame with a barbell supported on the contoured edges of the upper portions, demonstrating the cradle configuration for Olympic bar sleeves, with the catch portions retaining the barbell in position, according to aspects of the present disclosure.

Referring to FIG. 3, a pair of support devices 100 are shown mounted to a door frame 156 with a barbell 152 supported on the contoured edges 122 of the upper portions 104. The support devices 100 are attached to opposite sides of the door frame 156 using mechanical fasteners extending through the fastener apertures 116 in the upper portions 104 of the plate members 102. The barbell 152 rests within the curved portions defined by the contoured edges 122, which are configured to receive and support the barbell 152 in a stable position. An optional tie-down feature may be employed for additional security when a bar rests on the support devices 100. In some aspects, the tie-down feature may comprise a strap, cord, bungee, or similar securing element that may be threaded through one of the openings, such as the first opening 112, or looped around the barbell 152 to prevent the barbell 152 from accidentally lifting off or displacing from the contoured edge 122 during use. The tie-down feature may restrain upward or lateral movement of the barbell 152 when resting on the support devices 100, providing additional security during exercises where the barbell 152 may be subject to forces that could otherwise cause displacement from the contoured edges 122. In some cases, the tie-down feature may be removable and may be attached or detached depending on user preference or the type of exercise being performed.

With continued reference to FIG. 3, the contoured edge 122 of each upper portion 104 is configured to cradle an elongated exercise implement on its sleeves or on its bar shaft. As used herein, sleeves refer to the end portions of a barbell where weight plates are loaded, which typically have a larger diameter than the central shaft of the barbell. The curved geometry of the contoured edge 122 allows an Olympic bar to rest on its sleeves, with the sleeves positioned within the cradle region defined by the contoured edge 122. In some configurations, depending on the bar width and door opening size, the barbell may alternatively rest on the bar shaft itself rather than on the sleeves. The catch portion 126 is designed to accommodate either configuration, such that the sleeves may roll and rest against the catch portion 126, or the plain bar shaft may rest against the catch portion 126. Either way, the barbell will fit and rest against the catch portion 126 in a stable position. The contoured edge 122 accommodates bars of different configurations, including Olympic bars having larger diameter sleeves at each end of the bar shaft and standard bars where the bar shaft may contact the contoured edge 122 directly.

Floor Stand Configuration

Figure 4:
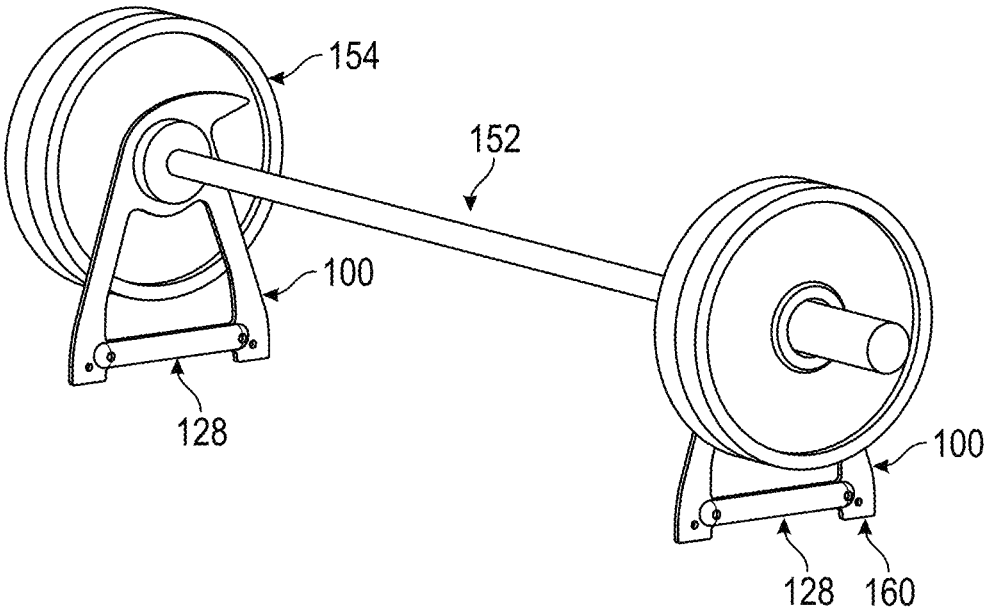
FIG. 4 illustrates a perspective view of a pair of support devices positioned on a floor surface functioning as floor stands with a barbell extending through the second openings, showing the weight plates and grip assemblies configured to swivel while maintaining a downward orientation due to gravity, according to aspects of the present disclosure.

Referring to FIG. 4, a pair of support devices 100 are shown positioned on a floor surface 160 and functioning as floor stands for supporting a barbell 152 with weight plates 154. The support devices 100 are oriented such that the second openings 114 receive the barbell 152 therethrough, with the barbell 152 extending horizontally through the second openings 114 of both support devices 100. In this configuration, the support devices 100 function as floor stands for supporting the barbell 152 above the floor surface 160, providing clearance between the weight plates 154 and the floor surface 160.

With continued reference to FIG. 4, each support device includes a grip assembly 128 attached to the lower portion of the plate member. When the support device is positioned on a floor surface, the grip assembly 128 contacts the floor surface and provides stable support. The grip assembly 128 is configured to swivel while maintaining a downward orientation due to gravity. As the support device turns or rotates during use, the grip assembly 128 remains oriented downwardly due to gravitational forces acting on the grip assembly 128, such that the grip assembly 128 maintains contact with the floor surface regardless of the rotational position of the plate member.

The grip assembly 128 shown in FIG. 4 is illustrated in a configuration where the grip assembly 128 is recessed relative to the recess 136 on the lateral portion 108 of the plate member 102. This differs from the configuration shown in FIG. 2, where the grip assembly 128 is substantially flush with the lateral portion 108 when assembled. Either configuration may be employed without detracting from the functionality of the support device 100, as both configurations permit the grip assembly 128 to contact the floor surface and provide stable support when the support device 100 is positioned on a floor surface. The recessed configuration and the flush configuration represent alternative assembly arrangements that may be selected based on manufacturing tolerances, user preference, or the specific exercise application.

The floor stand configuration elevates the barbell and weight plates off the floor surface, facilitating loading and unloading without requiring a user to lift the barbell from the ground. The arrangement shown in FIG. 4 demonstrates how two support devices 100 work in tandem to provide balanced support for a loaded barbell assembly, with weight plates loaded on each end of the barbell.

Mounting Hardware Configuration

The support device may be used for one arm row isolation technique lifting exercises when positioned on a floor surface. In this exercise application, the support device supports the barbell at an elevated position above the floor surface, with the barbell extending through the second opening, allowing a user to grasp the barbell with one arm and perform rowing movements while the opposite end of the barbell remains supported by the support device. The floor stand configuration provides stability during the one arm row isolation technique, with the grip assembly 128 swiveling as appropriate while maintaining the downward orientation due to gravity to keep the support device stable on the floor surface.

Figure 5:
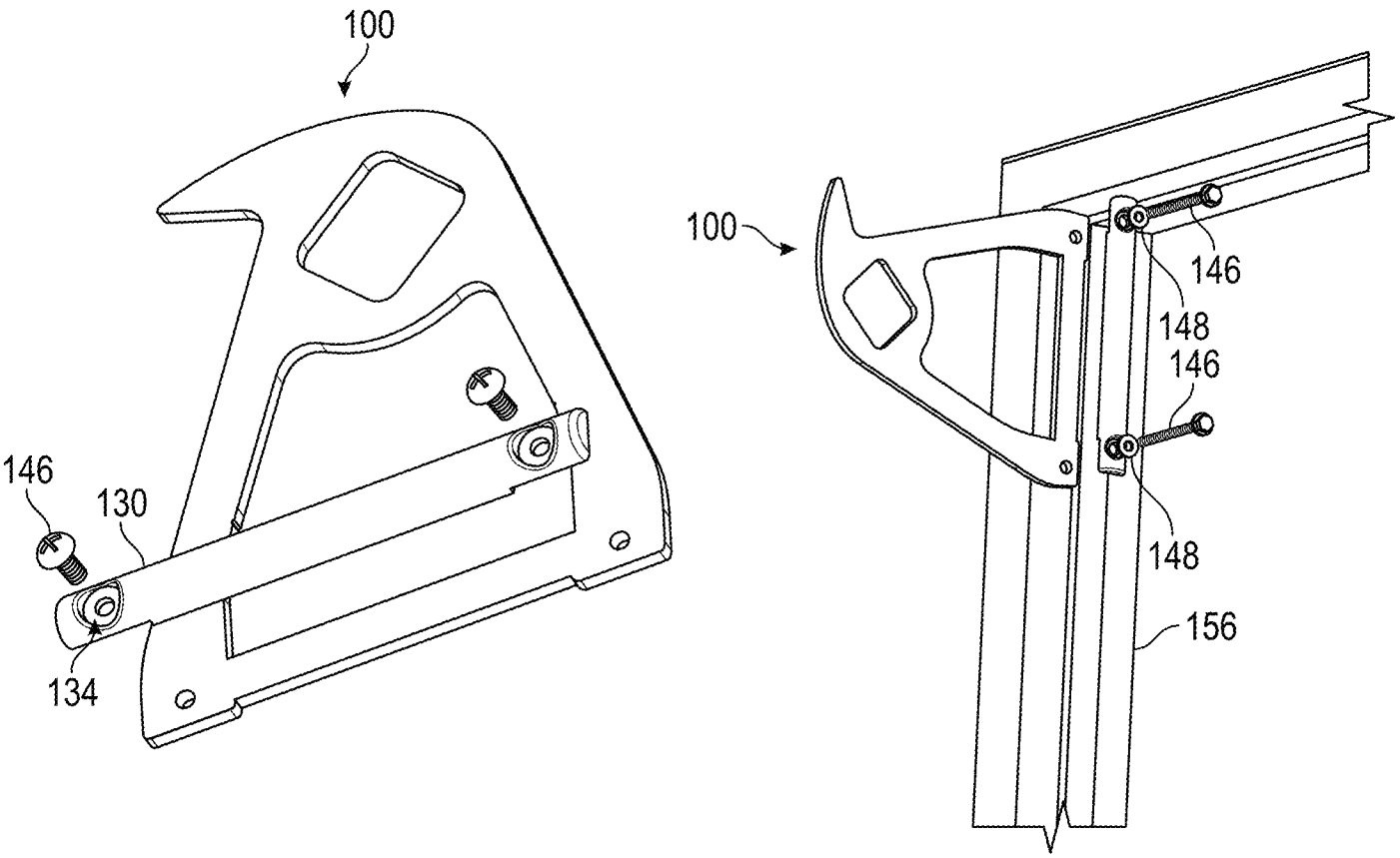
FIG. 5 illustrates the support device and mounting hardware including lag bolts and washers, showing the support device both alone and mounted to a door frame, with the first buffer portion and fastener apertures, according to aspects of the present disclosure.

Referring to FIG. 5, an exploded view illustrates the support device and mounting hardware configured for attachment to a supporting structure such as a door frame 156. The support device includes the plate member with the first opening in the upper region and the second opening below the first opening. The plate member is formed from metal and has a uniform thickness of approximately 0.25 inches throughout the profile of the plate member. With continued reference to FIG. 5, the support device further comprises at least one mechanical fastener 146 configured to extend through the fastener aperture and into a supporting structure such as a door frame 156. The mechanical fasteners 146 may comprise lag bolts having a diameter of five-sixteenths of an inch. In some aspects, the mechanical fasteners may include various configurations such as lag bolts, hex nuts with washers, flange nuts (which combine a nut and an anti-slip washer ring as a single integrated part), screws, or wall-mounted lag bolts. Any or all of these fastener types may be employed depending on the installation requirements or user preference. Alternative fastener configurations may be used in cases where the original mounting hardware is unavailable or where a user prefers a different fastening approach. The fastener apertures 116 are positioned near corners of the upper portion of the plate member and are configured to receive the mechanical fasteners for securing the support device to the supporting structure.

As further shown in FIG. 5, the mounting hardware includes washers 148 configured to be positioned between the lag bolts 146 and the plate member. The washers 148 distribute the clamping force of the lag bolts 146 across a larger surface area of the plate member when the support device is mounted to the supporting structure. The lag bolts 146 and washers 148 pass through the fastener apertures 116 in the upper portion of the plate member to secure the support device to a vertical support structure such as a door frame 156 or wall stud.

The mounting configuration shown in FIG. 5 demonstrates the relationship between the plate member, the mounting hardware including the lag bolts 146 and washers 148, and the supporting structure. Pre-drilling of the supporting structure may be performed prior to installation of the lag bolts 146 to facilitate secure attachment of the support device to the door frame 156 or wall.

Method of Installation

The support device may be installed on a door frame or wall using a weight plate as a reference tool to determine proper mounting position and wall clearance. In some aspects, a user may employ a standard or Olympic weight plate, such as a 25 lb weight plate, as a positioning guide during installation. The weight plate provides a reference for verifying that the support device is positioned at an appropriate distance from the wall to accommodate a barbell with weight plates when the support device is mounted.

In one method of installation, the user rolls the weight plate so that it contacts the wall surface adjacent to the door frame. With the weight plate positioned against the wall, the user places the support device on top of the weight plate to check door frame fitting and to verify that the fastener apertures align with studs inside the door frame. This positioning technique allows the user to confirm that the mounting location provides sufficient clearance from the wall to accommodate the diameter of weight plates that will be used with the barbell.

After verifying proper positioning using the weight plate reference, the user may mark the measurement on the door frame to indicate the drilling locations for the fastener apertures. The user may test the diameter of plates fitting for bar rack adjustments before drilling to ensure that the selected mounting position accommodates the intended weight plate sizes. Pre-drilling of the door frame may be performed at the marked locations prior to installation of the lag bolts.

The support device may be mounted at multiple height positions on the door frame depending on the intended exercise application. In some configurations, the support device may be mounted at a pull-up height position near the top of the door frame for pull-up exercises or for suspending accessories such as dip rings and suspension trainers. The support device may alternatively be mounted at a squat rack height position at an intermediate height on the door frame for squat exercises. In other configurations, the support device may be mounted at a bench press rack height position at a lower height on the door frame for bench press exercises performed with a bench positioned beneath the supported barbell. Multiple support devices may be installed at different heights on the same door frame to provide multiple support levels for various exercise types.

Grip Assembly Components

Figure 6:
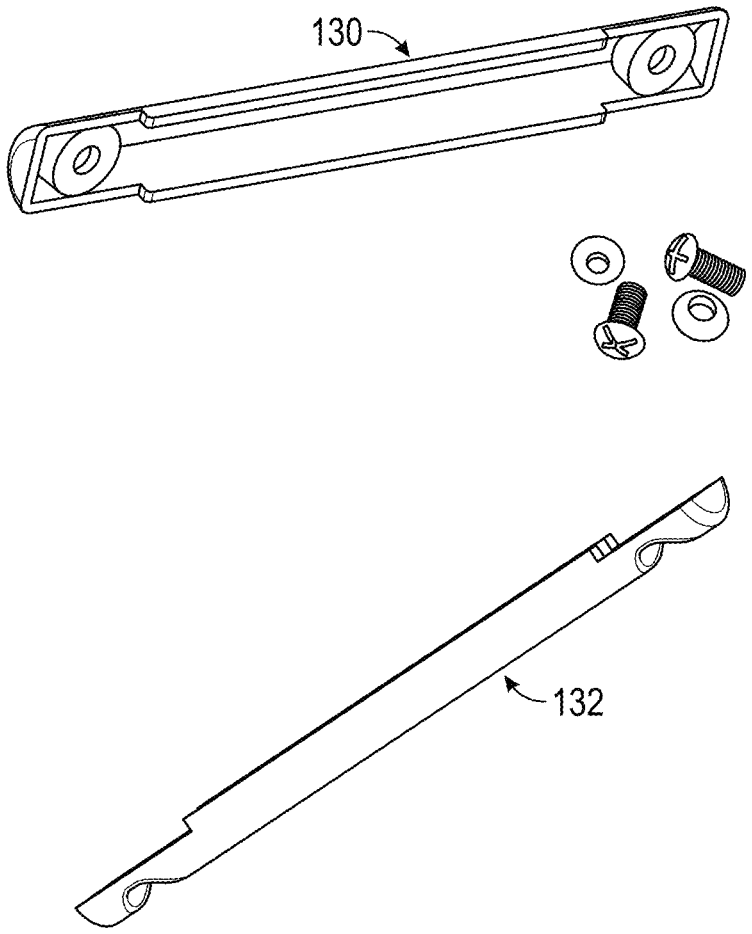
FIG. 6 illustrates an exploded view showing the support device and the grip assembly components including the plate member with the recess, the first buffer portion, the second buffer portion, and grip assembly fasteners configured to secure the buffer portions together around the lower portion, according to aspects of the present disclosure.

Referring to FIG. 6, an exploded view illustrates the components of the grip assembly 128 and the relationship between the grip assembly 128 and the plate member 102. The plate member 102 is shown as a flat steel cut out forming the main body of the support device 100, with the first opening 112 in the upper region and the second opening 114 below the first opening 112. The lateral portion 108 of the plate member 102 includes a recess 136 formed therein. The recess 136 is configured to receive corresponding portions of the grip assembly 128 such that the grip assembly 128 sits flush with the lateral portion 108 of the plate member 102 when assembled, preventing the grip assembly 128 from creating a bulge that could cause tipping when the support device 100 is positioned on a floor surface.

With continued reference to FIG. 6, the grip assembly 128 comprises a first buffer portion 130 and a second buffer portion 132 configured to attach to opposing sides of the lower portion 106 of the plate member 102. Each of the first buffer portion 130 and the second buffer portion 132 includes a protrusion 138 configured to engage the recess 136 to secure the grip assembly 128 to the plate member 102. The protrusions 138 extend from the inner surfaces of the buffer portions and are shaped to fit within the recess 136 on the lateral portion 108 of the plate member 102. When the first buffer portion 130 and the second buffer portion 132 are assembled around the lower portion 106, the protrusions 138 engage the recess 136 such that the grip assembly 128 is substantially flush with the plate member 102 when assembled. This flush configuration provides a stable base when the support device 100 is used as a floor stand, preventing tipping that could otherwise occur if the grip assembly 128 protruded beyond the lateral portion 108. Grip assembly fasteners 139 extend through the fastener apertures 134 to secure the first buffer portion 130 and the second buffer portion 132 together around the lower portion 106.

As further shown in FIG. 6, the first buffer portion 130 and the second buffer portion 132 are formed from a polymer material. The polymer material of the buffer portions functions to dampen impacts to the floor and dragging during use of the support device. The buffer portions also function as two-sided grips and provide grip surfaces for users during exercises involving direct hand contact with the support device.

The grip assembly configuration illustrated in FIG. 6 represents one embodiment of the grip assembly, and the grip assembly may be molded or formed in many different ways from many different materials. In some aspects, the grip assembly may be formed from rubber, silicone, thermoplastic elastomer (TPE), polyurethane, nylon, ABS plastic, polycarbonate, fiberglass-reinforced polymer, carbon fiber composite, aluminum, or wood. In some cases, the grip assembly may be formed from combinations of these materials or from other suitable materials that provide desired characteristics such as durability, grip texture, impact resistance, or aesthetic appearance. The manufacturing process for the grip assembly may include injection molding, compression molding, extrusion, machining, casting, or other forming techniques depending on the selected material and desired properties of the finished grip assembly.

In some aspects, the grip assembly 128 may be interchangeable and customizable. The first buffer portion 130 and the second buffer portion 132 may be replaceable with alternative grip configurations that vary in material, surface texture, contour, and color. By way of example, the grip assembly 128 may include bamboo-style grips, samurai-style grips, grips configured for grip tape wrapping, grips bearing logo designs, or rolling covers that may be positioned over the grip to alter rotation characteristics or tactile feel. In some cases, the components may be swapped by removing fasteners from the fastener apertures 134 and installing substitute buffer portions to tailor ergonomics and appearance to user preference.

The grip assembly 128 includes a polymer guide having a diameter of approximately 0.8 inches with insets for screws. When the support device is mounted to a door frame or overhead structure without a barbell installed, athletic tape may be wrapped around the grip section of the lower portion to enhance grip during pull-up exercises. In this configuration, a user may grasp the grip section and perform pull-up exercises using the support device as an overhead anchor point, with the athletic tape providing an additional exercise modality and improved tactile grip surface. The insets for screws are configured to receive mechanical fasteners that secure the first buffer portion 130 and the second buffer portion 132 together around the lower portion of the plate member. The grip assembly 128 includes an inner surface inset configured to receive the metal plate member around which the grip assembly 128 attaches. The inner surface inset provides a recessed area within each buffer portion that accommodates the thickness of the plate member when the buffer portions are assembled.

The lower portion includes a recessed region on the bottom where the buffer portions have a corresponding region to connect around the bottom part for an enhanced secure connection. The recessed region on the bottom of the lower portion cooperates with the protrusions 138 on the buffer portions to provide a secure mechanical interface between the grip assembly 128 and the plate member. The corresponding region on each buffer portion wraps around the bottom part of the lower portion, engaging the recessed region to prevent relative movement between the grip assembly 128 and the plate member during use.

Standard and Olympic Size Embodiments

Figure 7:
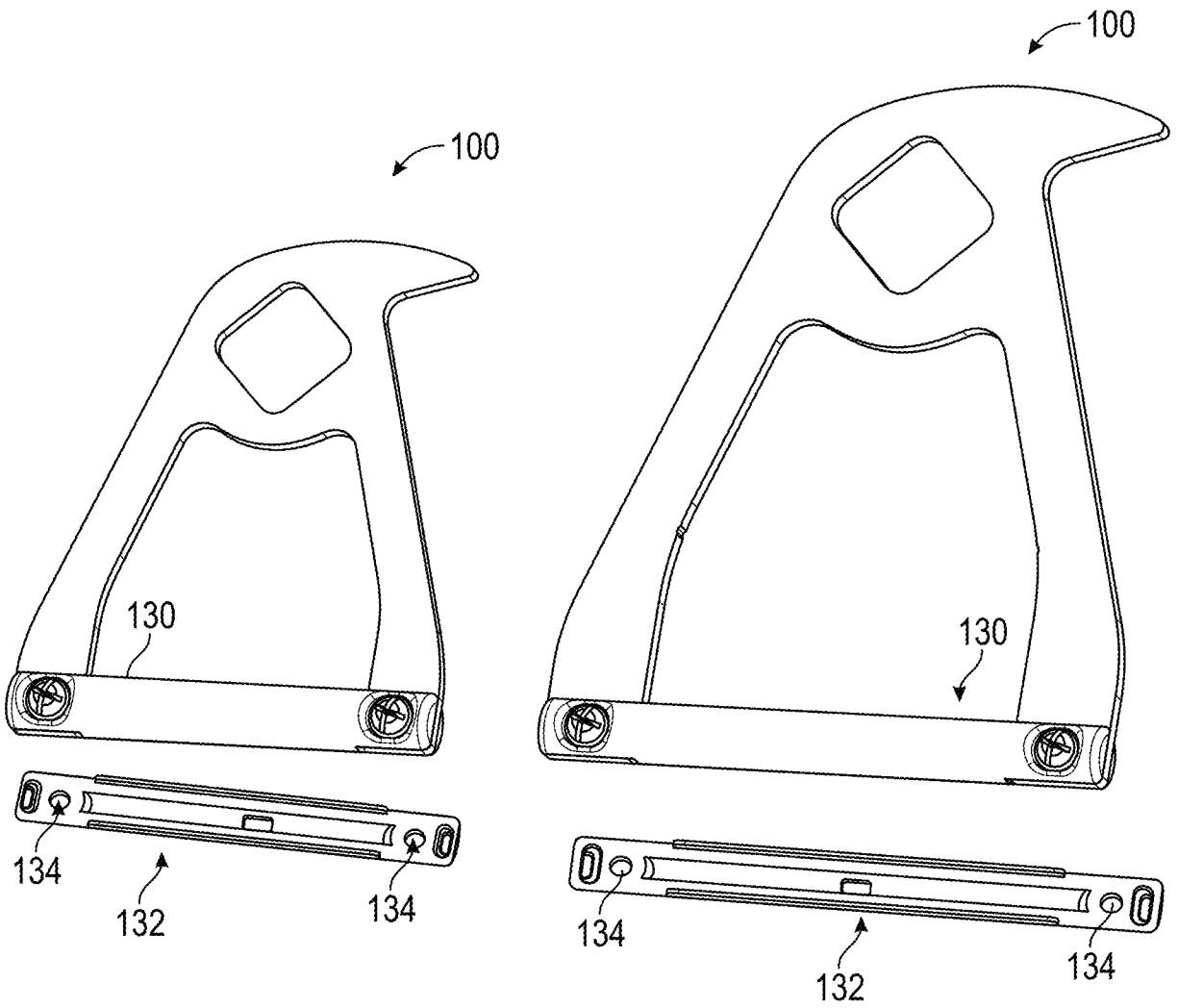
FIG. 7 illustrates a comparison view of a standard-size embodiment configured for one-inch diameter barbell shafts and an Olympic-size embodiment configured for two-inch diameter barbell shafts, showing the first buffer portion, the second buffer portion, and the fastener apertures, including a notch configured to indicate a measurement of clearance distance between a mounted barbell and a wall surface, according to aspects of the present disclosure.

Referring to FIG. 7, a comparison view illustrates two embodiments of the support device, including a standard-size embodiment and an Olympic-size embodiment. The standard-size embodiment is configured for use with standard weights, while the Olympic-size embodiment is configured for use with Olympic weights. The two embodiments share the same general configuration of the plate member with the first opening, the second opening, and the fastener apertures 116, but differ in overall dimensions and in the sizing of the openings to accommodate different barbell shaft diameters.

With continued reference to FIG. 7, the second opening may be sized to receive a barbell shaft having a diameter of approximately one inch for standard weights in the standard-size embodiment. Alternatively, the second opening may be sized to receive a barbell shaft having a diameter of approximately two inches for Olympic weights in the Olympic-size embodiment. The different sizing of the second opening between the two embodiments allows the support device to accommodate the different shaft diameters associated with standard and Olympic barbell configurations.

The first opening has a generally trapezoidal shape, providing an internal area for reaching into and positioning a bar within the support device.

As further shown in FIG. 7, the Olympic-size embodiment of the support device has a height of approximately 9 inches on the right side of the plate member. The Olympic-size embodiment has a total length of approximately 11 inches at its longest point. The first opening in the Olympic-size embodiment has dimensions of approximately 6 inches long and 6 inches in height. The second opening in the Olympic-size embodiment has each side measuring approximately 2 inches with a rounded corner square shape. The tapered protrusion extends approximately 2 inches from the base of the sloped upper region in the Olympic-size embodiment. The fastener aperture centers are spaced approximately 7.5 inches apart in the Olympic-size embodiment.

The standard-size embodiment of the support device has a height of approximately 6.75 inches. The standard-size embodiment has a total length of approximately 8.125 inches at its longest point. The first opening in the standard-size embodiment has a height of approximately 4.5 inches and a length of approximately 3.75 inches. The second opening in the standard-size embodiment has dimensions of approximately 2.75 inches for receiving a standard barbell shaft. The tapered protrusion extends approximately 1.5 inches from the sloped region in the standard-size embodiment. The fastener aperture centers are spaced approximately 5.375 inches apart in the standard-size embodiment. The shorter overall dimensions of the standard-size embodiment allow more clearance space for wall positioning when racking a barbell.

The upper portion includes a notch 150 configured to indicate a measurement of clearance distance between a mounted barbell and a wall surface. The notch 150 provides a template for determining whether the support device is positioned at an appropriate distance from a wall to accommodate a barbell with weight plates. The notch 150 may be used to verify that the support device is not set back too far from the wall, which could prevent adequate space for a standard size barbell with weight plates to be positioned on the support device. In some configurations, plates wider in diameter than 25-pound plates may not fit on the rack when positioned against the wall. The notch 150 is shown in the Olympic-size embodiment in FIG. 7 and provides an estimate of barbell to wall clearance when the support device is mounted to a door frame or wall.

Structural Elements and Features

Figure 8:
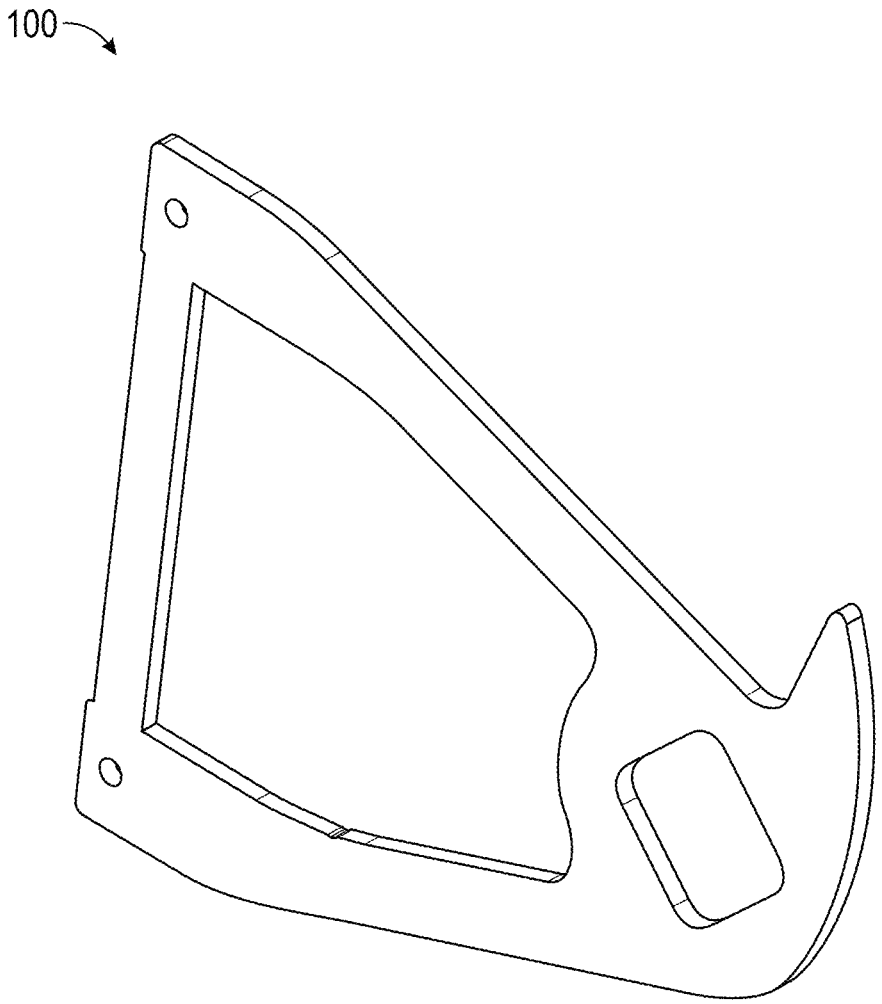
FIG. 8 illustrates a perspective view of the support device of FIG. 1.

Referring to FIG. 8, an annotated isometric view illustrates the structural elements and features of the support device. The plate member is shown with the first opening formed through the plate member and bounded by the upper portion and the lateral portion. The first opening has a generally trapezoidal shape bounded by sloped inner edge surfaces extending from the upper portion 104 toward the lateral portion 108, and provides an access opening for reaching into and positioning a bar within the support device.

With continued reference to FIG. 8, the catch portion 126 is positioned adjacent to the contoured edge of the upper portion. The catch portion 126 extends upwardly from the upper portion to define a raised barrier that prevents an elongated exercise implement from displacing laterally when resting on the contoured edge. When a barbell is placed on the contoured edge, it rolls down the slope until it contacts the catch portion 126, which retains the barbell in a stable position.

As further shown in FIG. 8, the second opening has a rounded rectangular shape with curved corners and is laterally offset from the first opening. The lateral offset positioning of the second opening relative to the first opening provides clearance between the two openings while maintaining structural integrity of the plate member. The rounded rectangular shape with curved corners of the second opening accommodates barbell shafts of different diameters, including two-inch Olympic barbell shafts and standard one-inch barbell shafts.

The second opening is configured to receive a cable attachment or a D-ring for cable-based exercises. The geometry of the second opening permits cable attachments to pass through the second opening and interface with the support device for exercises utilizing cable resistance. A D-ring may be coupled to the second opening to provide an attachment point for cables, straps, or other exercise accessories.

The support device may interface with straps as additional accessory components coupled to the openings or edges of the plate member. Straps may be threaded through the first opening or the second opening to provide attachment points for suspension exercises or to secure the support device to external structures. The strap attachment interface provided by the openings in the plate member allows the support device to accommodate various exercise configurations utilizing strap-based resistance or suspension.

The support device may interface with handles as additional accessory components coupled to the openings or edges of the plate member. Handles may be attached to the first opening or the second opening to provide gripping surfaces for exercises such as dip exercises or pull-up exercises. When no bar is installed, athletic tape may be wrapped around the grip section of the lower portion 106 to facilitate pull-up exercises. The handle attachment interface provided by the openings in the plate member allows the support device to function as a mounting platform for removable handle accessories.

As described previously, the upper portion includes a downwardly extending portion 120 terminating in a tapered protrusion that extends upwardly from the plate member. The downwardly extending portion 120 and the tapered protrusion are shown in FIG. 8 as the downwardly extending portion with the tapered tip. The tapered protrusion provides a termination point for the upper portion and the catch portion 126 is positioned on the left side of the tapered protrusion where a barbell comes to rest after rolling down the contoured edge.

Bench Press Exercise Configuration

Figure 9:
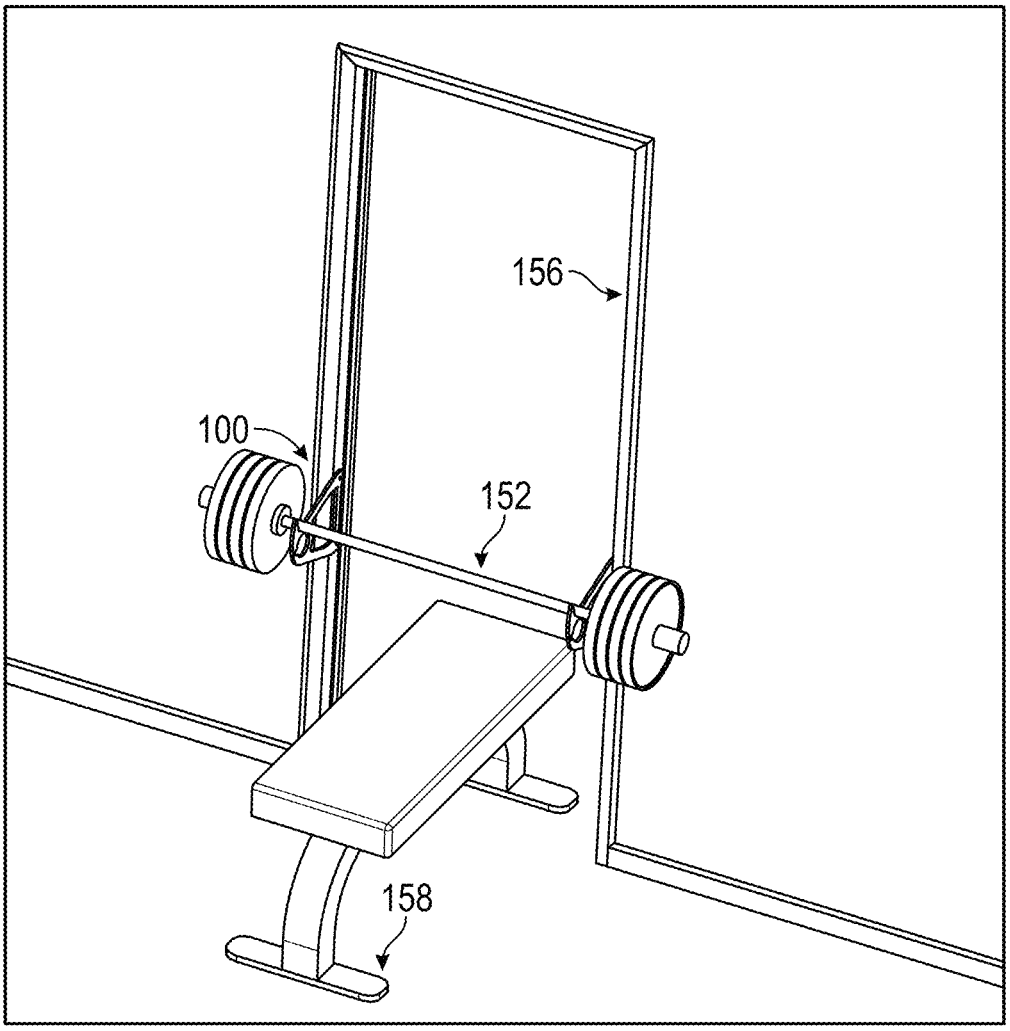
FIG. 9 illustrates a perspective view of a pair of support devices mounted to a door frame with a bench positioned beneath a supported barbell, with the barbell resting on the contoured edges of the upper portions for bench press exercises, according to aspects of the present disclosure.

Referring to FIG. 9, a pair of support devices 100 are shown mounted to a door frame 156 with a bench 158 positioned beneath a supported barbell 152 for bench press exercises. The support devices 100 are attached to opposite sides of the door frame 156 at a height suitable for bench press exercises, with the barbell 152 resting on the contoured edges 122 of the upper portions 104. The bench 158 is positioned beneath the barbell 152 such that a user lying on the bench 158 may reach upward to grasp the barbell 152 and perform bench press movements. The load capacity of the mounted configuration may depend on factors including how well the lag bolts are torqued into the structural members of the door frame 156, such as the studs. In some aspects, proper installation into solid structural members may contribute to enhanced load capacity. For enhanced safety and load capacity, hardened steel fasteners may be employed, although such fasteners are not required for operation of the support device.

With continued reference to FIG. 9, the support devices 100 may be mounted to a supporting structure at an appropriate height for bench press exercises. The mounting height positions the barbell 152 at a level that allows a user to unrack the barbell 152 from the support devices 100 while lying in a supine position on the bench 158. After completing a set of bench press repetitions, the user may return the barbell 152 to the support devices 100 by guiding the barbell 152 back onto the contoured edges 122. The barbell 152 rolls down the contoured edges 122 toward the catch portions 126, which prevent the barbell 152 from displacing laterally when the barbell 152 is returned to the support devices 100.

The bench press exercise configuration demonstrates the versatility of the support device for accommodating different exercise types through adjustment of the mounting height on the supporting structure. The fastener apertures 116 in the upper portions 104 of the plate members 102 receive mechanical fasteners that secure the support devices 100 to the door frame 156 at the selected height appropriate for bench press exercises. The support devices 100 may be repositioned to different heights on the door frame 156 to accommodate users of different sizes or to adjust the starting position of the barbell for different bench press variations.

Accessory Attachment Configuration

Figure 10:
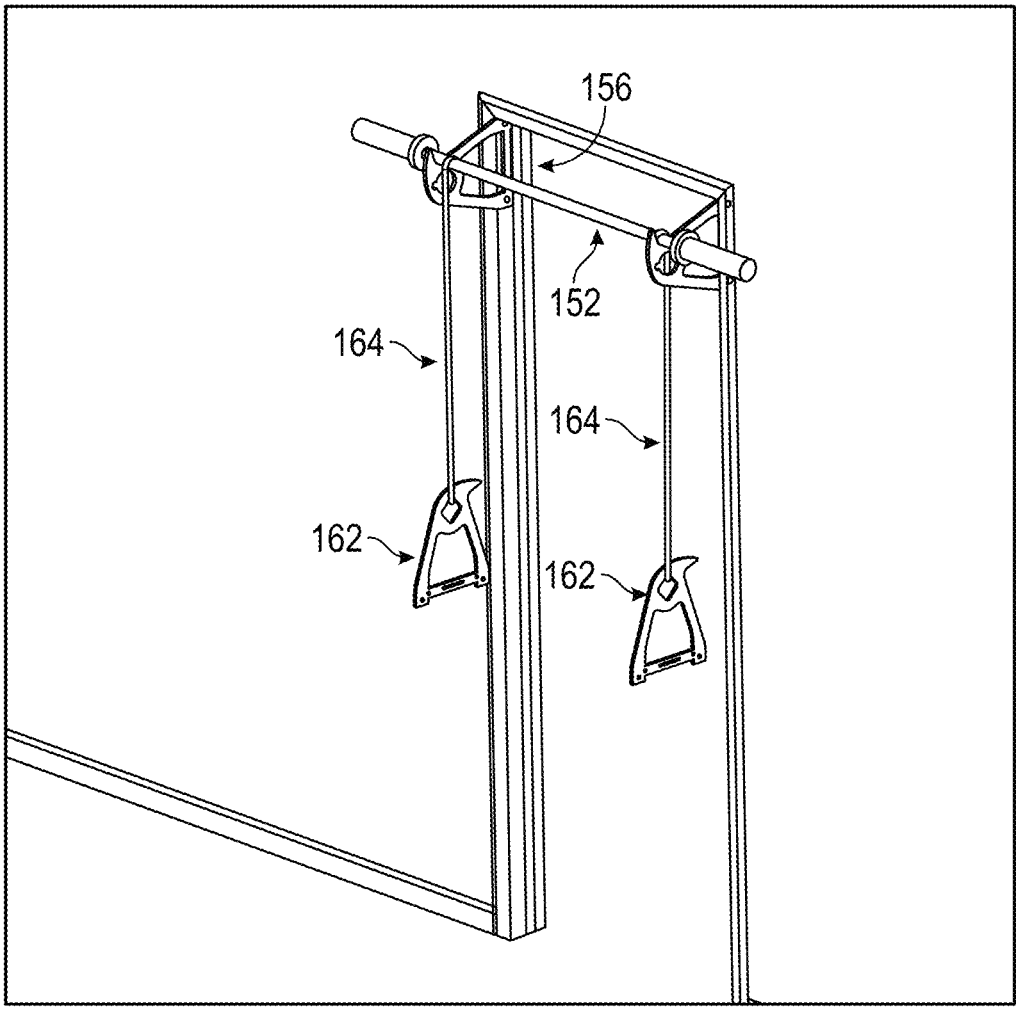
FIG. 10 illustrates a perspective view of a pair of support devices mounted to a door frame with dip rings and suspension trainer accessories suspended from a barbell supported by the devices, according to aspects of the present disclosure.

With continued reference to FIG. 10, the dip rings 162 are shown hanging from the barbell 152, with each dip ring 162 suspended by a strap that loops over the barbell 152. The suspension trainer 164 straps are also attached to the barbell 152, extending downward from the supported bar. This configuration demonstrates how the support devices 100 function as a mounting platform for exercise accessories, with the barbell 152 serving as an overhead support structure from which the dip rings 162 and suspension trainer 164 are suspended.

The suspension trainer accessories shown in FIG. 10 may also be attached to the bar supported by the support devices 100. The suspension trainer accessories provide additional exercise options beyond dip exercises, including various pulling and pushing movements utilizing body weight resistance. The openings in the plate members 102, including the first openings 112 and the second openings 114, may receive straps, cables, or other attachment components associated with the dip rings and suspension trainer accessories. The geometry of the openings permits the attachment components to pass through the openings and interface with the support devices 100 for exercises utilizing the suspended dip rings and suspension trainer accessories.

Figure 11:
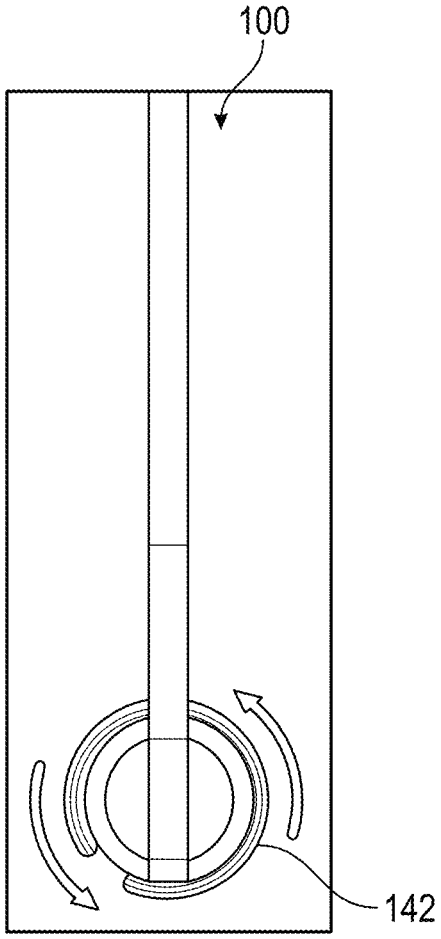
FIG. 11 illustrates an embodiment of the support device that includes a rotatable sleeve around the cylindrical grip surface, according to aspects of the present disclosure.

Referring to FIG. 11, the support device 100 is shown with a rotatable sleeve 142 disposed around the cylindrical grip surface 140 of the grip assembly 128. Curved arrows adjacent to the rotatable sleeve 142 indicate the rotational capability of the sleeve, demonstrating that the rotatable sleeve 142 is configured to spin freely around the cylindrical grip surface 140. This configuration allows the support device 100 to accommodate exercises that involve rotation in the grip area, such that a user may rotate their grip without the support device 100 rotating or without friction between the user's hands and the grip surface. The rotatable sleeve 142 includes a retention element 144 configured to prevent removal of the sleeve from the grip assembly 128. The rotatable sleeve 142 reduces strain on the user's wrists and forearms during rotational movements by allowing the sleeve to rotate separately from the grip assembly 128 and the plate member 102.

Comprehensive Embodiment

In a comprehensive embodiment of the support device, the plate member is formed from metal. The metal construction of the plate member provides structural rigidity and durability for supporting elongated exercise implements such as barbells with weight plates. The plate member may be formed from steel or other suitable metal materials capable of withstanding the loads associated with exercise equipment.

The support device includes a grip assembly 128 comprising a first buffer portion 130 and a second buffer portion 132. The first buffer portion 130 and the second buffer portion 132 are formed from a polymer material. Each of the first buffer portion 130 and the second buffer portion 132 includes fastener apertures 134 configured to receive mechanical fasteners. Grip assembly fasteners 139 extend through the fastener apertures 134 to secure the first buffer portion 130 and the second buffer portion 132 together around the lower portion of the plate member. The polymer material of the buffer portions provides impact dampening and grip surfaces while the fastener apertures 134 enable secure attachment of the buffer portions to each other and to the plate member.

As described previously, the lateral portion of the plate member includes a recess 136, and each of the first buffer portion 130 and the second buffer portion 132 includes a protrusion 138 configured to engage the recess 136 to secure the grip assembly 128 to the plate member. The engagement between the protrusions 138 and the recess 136 results in the grip assembly 128 being generally flush with the lateral portion of the plate member when assembled, providing a stable, non-tipping base when the support device is positioned on a floor surface.

The first opening has a generally trapezoidal shape. The trapezoidal shape of the first opening provides an internal area for reaching into and positioning a bar within the support device.

The second opening is positioned below and laterally offset from the first opening. The lateral offset positioning of the second opening relative to the first opening provides clearance between the two openings while maintaining structural integrity of the plate member between the two openings. When the support device is positioned on a floor surface, the second opening receives the barbell therethrough to support the barbell above the floor surface.

The at least one fastener aperture comprises two fastener apertures 116 positioned near corners of the upper portion. The two fastener apertures 116 are configured to receive lag bolts 146 having a diameter of five-sixteenths of an inch for mounting the support device to a door frame 156. The positioning of the two fastener apertures 116 near the corners of the upper portion distributes the mounting forces across the upper region of the plate member when the support device is secured to a supporting structure.

The support device further comprises lag bolts 146 and washers 148 configured to extend through the fastener apertures 116 and into a door frame 156. The lag bolts 146 pass through the fastener apertures 116 in the upper portion of the plate member, with the washers 148 positioned between the lag bolt heads and the plate member. The lag bolts 146 extend into the door frame 156 to secure the support device in position for supporting exercise implements. The washers 148 distribute the clamping force of the lag bolts 146 across a larger surface area of the plate member.

The catch portion 126 extends upwardly from the upper portion adjacent to the contoured edge to define a raised barrier preventing lateral displacement of an elongated exercise implement resting on the contoured edge. The upward extension of the catch portion 126 from the upper portion creates a physical barrier that retains a barbell or other elongated exercise implement on the contoured edge during use. The catch portion 126 cooperates with the contoured edge to guide and retain elongated objects in a stable position when the support device is mounted to a door frame 156 or wall.

Additional Uses and Applications

The support device may be used for applications beyond exercise equipment support. The contoured edge and the openings formed through the plate member may be leveraged to crack shells of hard-shelled objects such as coconuts. When opening a coconut, a user may position the coconut against the contoured edge or against an edge surface bounding one of the openings and apply force to crack the coconut shell. The rigid construction of the plate member provides a stable surface against which the coconut shell may be struck or pressed to initiate cracking. The geometry of the contoured edge and the openings provides leverage points that concentrate applied force to facilitate shell cracking.

In one method of opening a coconut using the support device, the user may hold the support device in one hand and the coconut in the other hand, then strike the coconut against the contoured edge or the tapered protrusion with sufficient force to crack the shell. Alternatively, the user may position the support device on a stable surface such as a countertop or floor, place the coconut against one of the inner edge surfaces of the first opening or the second opening, and apply downward pressure or strike the coconut to initiate cracking. The metal construction of the plate member provides sufficient rigidity and durability to withstand repeated impacts without deformation. The curved geometry of the contoured edge concentrates the impact force along a narrow line of contact, facilitating crack initiation in the hard coconut shell. The user may rotate the coconut and repeat the striking or pressing action at multiple locations around the circumference of the coconut until the shell is sufficiently cracked to permit separation and access to the coconut meat and water inside.

The support device may be sold as a kit including multiple devices and mounting hardware configured for installation at multiple positions on a door frame 156. The kit may include two or more support devices that may be mounted at different heights on opposite sides of a door frame 156 to provide multiple support levels for exercise implements. The mounting hardware included in the kit may comprise lag bolts, washers, and other fasteners configured to secure the support devices to the door frame 156 at selected vertical positions. The multi-device kit package allows a user to configure a complete exercise station using a single door frame 156 as the supporting structure, with the multiple support devices positioned at heights appropriate for different exercise types including bench press exercises, standing exercises, and overhead suspension exercises. The kit configuration provides all components for installation without requiring separate purchase of mounting hardware. The generally planar configuration of the plate members and the modular design of the grip assembly components allow the kit to be packaged in a compact form factor suitable for flat-rate shipping boxes. The thin profile of the plate members and the ability to disassemble the grip assembly from the plate members enables efficient packaging where multiple support devices and associated hardware may be arranged within compact packaging dimensions. This compact packaging configuration facilitates shipping and storage. The kit may be transported or relocated with reduced effort due to the compact and lightweight nature of the disassembled components, making the kit suitable for home gym applications where space efficiency is desired.

Advantages of the Support Device

The support device accommodates both standard and Olympic weight configurations through variations in the sizing of the openings formed through the plate member. The standard-size embodiment includes a second opening sized to receive a barbell shaft having a diameter of approximately one inch, which corresponds to standard weight barbell configurations. The Olympic-size embodiment includes a second opening sized to receive a barbell shaft having a diameter of approximately two inches, which corresponds to Olympic weight barbell configurations. The availability of both standard and Olympic size embodiments allows users to select the support device configuration that matches their existing barbell equipment without requiring adapters or modifications.

The support device provides versatile mounting options including wall mounting and floor stand use. When mounted to a door frame or wall using mechanical fasteners extending through the fastener apertures, the support device functions as a wall-mounted barbell rack capable of supporting barbells at various heights depending on the mounting position selected by the user. When positioned on a floor surface with the second opening oriented to receive a barbell therethrough, the support device functions as a floor stand that elevates the barbell above the floor surface to facilitate loading and unloading and particular exercise movements.

The dual mounting capability allows a single support device to serve different exercise functions depending on the orientation and positioning selected by the user.

The support device is compatible with various accessories such as dip rings, suspension trainers, cable attachments, and D-rings. The openings formed through the plate member provide attachment interfaces for straps, cables, and other accessory components associated with dip rings and suspension trainers. The second opening is configured to receive cable attachments or D-rings for cable-based exercises, expanding the range of exercises that may be performed using the support device beyond barbell-based movements. The support device may also interface with standard gym cable machine hardware, including carabiner clips and pulley systems, allowing users to connect the device to existing cable resistance equipment for various pulling and pushing exercises. The accessory compatibility allows the support device to function as a central mounting platform for a variety of exercise modalities, including suspension training, cable resistance exercises, and dip ring exercises.

The support device includes a protective grip assembly that attaches to the lower portion of the plate member and provides impact dampening and grip surfaces. The grip assembly comprises buffer portions formed from a polymer material that functions to dampen impacts to the floor and dragging during use of the support device. The polymer material of the buffer portions protects floor surfaces from scratches or damage that may otherwise result from contact between the metal plate member and the floor surface. The grip assembly also provides grip surfaces for users during exercises involving direct hand contact with the support device, such as when the support device is used as a floor stand and the user grasps the grip assembly during exercise movements.

The support device may include a rotatable sleeve disposed around the cylindrical grip surface of the grip assembly for exercises involving rotation. The rotatable sleeve spins freely around the cylindrical grip surface while a retention element maintains the rotatable sleeve in position on the grip assembly. The rotatable sleeve accommodates exercises that involve rotation in the grip area, allowing the user to rotate their grip without the support device rotating or without friction between the user's hands and the grip surface. The rotatable sleeve configuration reduces strain on the user's wrists and forearms during rotational movements by allowing the sleeve to rotate separately from the grip assembly and the plate member.

REFERENCE NUMERALS

100 support device
102 plate member
104 upper portion
106 lower portion
108 lateral portion
110 perimeter edge
112 first opening
114 second opening
116 fastener apertures
120 downwardly extending portion
122 contoured edge
124 tapered protrusion
126 catch portion
128 grip assembly
130 first buffer portion
132 second buffer portion
134 fastener apertures (grip assembly)
136 recess
138 protrusion
139 grip assembly fasteners
140 cylindrical grip surface
142 rotatable sleeve
144 retention element
146 lag bolts
148 washers
150 notch
152 barbell
154 weight plates
156 door frame
158 bench
160 floor surface
162 dip rings
164 suspension trainer A number of implementations have been described. Nevertheless, it will be understood that various modifications may be made without departing from the spirit and scope of the disclosure. Accordingly, other implementations are within the scope of the following claims.

The invention claimed is:

1. A support device for exercise implements, comprising:

a plate member having a generally planar configuration and formed as a single unitary piece, the plate member defining an upper portion, a lower portion, and a lateral portion connecting the upper portion to the lower portion, the upper portion, the lower portion, and the lateral portion collectively defining a perimeter edge;

a first opening formed through the plate member and bounded by the upper portion and the lateral portion, the first opening extending fully through a thickness of the plate member and configured to receive an elongated exercise implement of the exercise implements;

a second opening formed through the plate member below the first opening, the second opening extending fully through the thickness of the plate member;

at least one fastener aperture formed in the plate member and configured to receive a mechanical fastener for mounting the support device to a supporting structure; and the upper portion including a downwardly extending portion defining a contoured edge configured to cradle the elongated exercise implement, the contoured edge sloping toward a catch portion configured to prevent the elongated exercise implement from displacing laterally;

wherein the upper portion terminates in a tapered protrusion adjacent to the catch portion;

wherein the lateral portion includes a recess configured to receive a grip assembly.

2. The support device of claim 1, wherein the catch portion extends upwardly from the upper portion to define a raised barrier adjacent to the contoured edge.

3. The support device of claim 1, wherein the first opening has a generally trapezoidal shape.

4. The support device of claim 1, wherein the second opening has a rounded rectangular shape with curved corners and is laterally offset from the first opening.

5. The support device of claim 1, wherein the second opening is sized to receive a barbell shaft having a diameter of approximately one inch for standard weights or approximately two inches for Olympic weights.

6. The support device of claim 1, wherein the at least one fastener aperture comprises two fastener apertures positioned near corners of the upper portion.

7. The support device of claim 1, wherein the catch portion extends upwardly from the upper portion to define a raised barrier adjacent to the contoured edge, wherein the first opening has a generally trapezoidal shape, wherein the second opening has a rounded rectangular shape with curved corners and is laterally offset from the first opening, wherein the second opening is sized to receive a barbell shaft having a diameter of approximately one inch for standard weights or approximately two inches for Olympic weights, wherein the at least one fastener aperture comprises two fastener apertures positioned near corners of the upper portion, wherein the plate member is formed from metal and has a uniform thickness of approximately 0.25 inches.

8. A support device for exercise implements, comprising:

a plate member having a generally planar configuration and formed as a single unitary piece, the plate member defining an upper portion, a lower portion, and a lateral portion connecting the upper portion to the lower portion, the upper portion, the lower portion, and the lateral portion collectively defining a perimeter edge;

a first opening formed through the plate member and bounded by the upper portion and the lateral portion, the first opening extending fully through a thickness of the plate member and configured to receive an elongated exercise implement of the exercise implements;

a second opening formed through the plate member below the first opening, the second opening extending fully through the thickness of the plate member;

at least one fastener aperture formed in the plate member and configured to receive a mechanical fastener for mounting the support device to a supporting structure;

the upper portion including a downwardly extending portion defining a contoured edge configured to cradle the elongated exercise implement, the contoured edge sloping toward a catch portion configured to prevent the elongated exercise implement from displacing laterally;

the upper portion terminating in a tapered protrusion adjacent to the catch portion; and a grip assembly removably coupled to the lower portion of the plate member, the grip assembly comprising a first buffer portion and a second buffer portion configured to attach to opposing sides of the lower portion.

9. The support device of claim 8, wherein the lateral portion includes a recess, and wherein each of the first buffer portion and the second buffer portion includes a protrusion configured to engage the recess such that the grip assembly is generally flush with the plate member when assembled.

10. The support device of claim 8, wherein the grip assembly defines a cylindrical grip surface having a diameter of between approximately 0.8 inches and approximately 1 inch.

11. The support device of claim 10, further comprising a rotatable sleeve disposed around the cylindrical grip surface.

* * * * *